United States Patent [19]

Takahashi

[11] 4,224,133

[45] Sep. 23, 1980

[54] CATHODE

[75] Inventor: Shuji Takahashi, Yokohama, Japan

[73] Assignee: Showa Denko K.K., Tokyo, Japan

[21] Appl. No.: 858,376

[22] Filed: Dec. 7, 1977

[51] Int. Cl.[2] ..... C25B 11/04; B61D 17/00

[52] U.S. Cl. ..... 204/290 R; 106/1.22; 204/43 P; 204/292; 427/438

[58] Field of Search ..... 204/43 P, 290 R, 292; 106/1.22; 427/438

[56] References Cited

U.S. PATENT DOCUMENTS

| | | | |
|---|---|---|---|
| 1,818,579 | 8/1931 | Pfleiderer | 204/129 |
| 2,929,742 | 3/1960 | de Minjer et al. | 427/438 |
| 3,354,059 | 11/1967 | Koretzky | 204/43 P |
| 4,033,835 | 7/1977 | Lerner | 204/43 S |

FOREIGN PATENT DOCUMENTS

| | | | |
|---|---|---|---|
| 1474163 | 3/1967 | France | 204/43 P |
| 785694 | 11/1957 | United Kingdom | 427/438 |

OTHER PUBLICATIONS de Minjer et al., Plating, vol. 44, pp. 1297–1305, Dec. 1957.

Modern Electroplating by Pearlstein, pp. 710–715, 718, 719, pub. by John Wiley & Sons, 1974.

*Primary Examiner*—F. C. Edmundson

*Attorney, Agent, or Firm*—Wenderoth, Lind & Ponack

[57] ABSTRACT

An improved cathode for the electrolysis of an aqueous solution of an alkali metal salt or water, the cathode having been plated in an electroless plating bath containing a salt of Ni, Co or Fe in the presence of a hypophosphite and as a reducing agent, a sulfur or selenium containing compound.

7 Claims, 2 Drawing Figures

CATHODE

Figure 1:
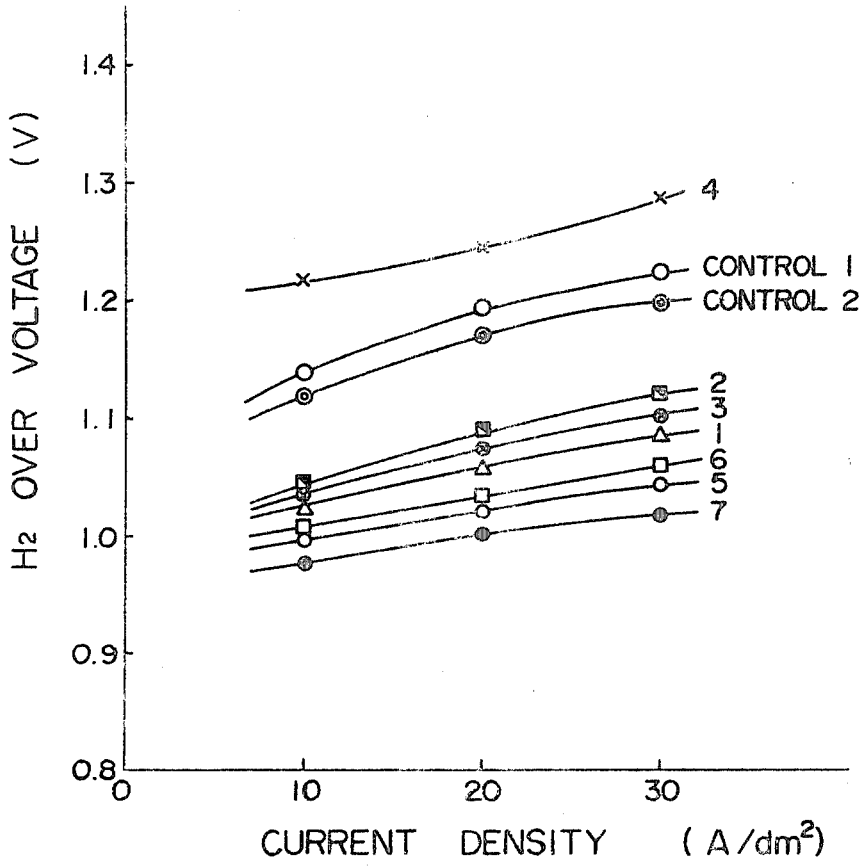

This invention relates to an improved cathode for the electrolysis of an aqueous solution of an alkali metal salt or water.

A method for producing sodium hydroxide by electrolyzing an aqueous solution of an alkali metal salt such as sodium chloride has been widely practised. The cathode used is generally made of nickel-plated iron or nickel metal, and is in such a shape as a plate, perforated plate, lattice or mesh. Cathodes of the latter three shapes mentioned are preferably used to obtain large total surface area. The cathode is required to have a low hydrogen overvoltage so as to achieve a low electrolytic voltage, and this low electrolytic voltage must be maintained over a long period of time. It is an object of this invention to provide an improved cathode which meets such a demand.

U.S. Pat. No. 1,818,579 discloses a process for producing an electrode for the electrolytic decomposition of water. The process comprises electrolytically preparing a metal electrode, of which at least the surface is sulfurized, and then superficially desulfurizing the electrode. The sulfurization is carried out, for example, by electrolytically plating the metal electrode in an aqueous bath containing an inorganic salt of nickel or cobalt and a reducing agent which is a sulfur compound such as thiosulfate or thiosulfuric acid, and then forming a coat of nickel or cobalt containing sulfur on the surface of the metal electrode. Subsequent desulfurization may be done by electrolytic treatment, for example by using the sulfurized electrode as a cathode in an alkaline solution for a length of time. The cathode so treated electrolytically has a considerably lower hydrogen overvoltage than a non-treated cathode, and therefore, can permit the initiation of the electrolysis of water at a lower electrolytic voltage. However, this low electrolytic voltage is maintained only within a relatively short period in the early stage of electrolysis. When such a cathode is used for the electrolysis of an aqueous solution of an alkali metal salt, the electrolytic voltage rapidly increases during electrolysis. In about 50 days, the electrolytic voltage is almost the same as that induced by the non-treated cathode. In other words, the cathode obtained by electrolytic plating treatment lacks durability. The electrolytic plating is difficult to apply to perforated plate, lattice or mesh electrodes because plating is not uniformly performed in the recessed parts of electrodes of such shapes.

According to the present invention, there is provided a cathode for the electrolysis of an aqueous solution of an alkali metal salt or water, said cathode consisting of a plate, perforated plate, lattice or mesh of iron, nickel-plated iron or nickel of which the surface is chemically plated in an aqueous electroless plating bath containing an inorganic salt of nickel, cobalt or iron in the presence of an alkali metal salt of hypophosphorous acid and a water-soluble reducing agent which is a sulfur or selenium containing compound.

The above cathode in accordance with this invention has a considerably lower hydrogen overvoltage than the nontreated cathode. However, as compared with the cathode obtained by electrolytic plating, it has a somewhat high hydrogen overvoltage at an early stage. Nevertheless, the level of the electrolytic voltage to be maintained during the electrolysis of an aqueous solution of alkali metal salts for long periods of time is far lower than in the case of the electrolytically plated cathode. It is evident that cathodes having such high durability are very advantageous in commercial operations which are performed continuously over a very long period of time.

The cathode of the present invention which can be obtained by chemical or electroless plating has the following features and advantages over those obtained by electrolytic plating.

(a) An electrolytic plating device is not required, and it is sufficient to use only a tank for accommodating an electroless plating bath for dipping the electrode therein;

(b) The thickness of the coating formed by chemical plating is uniform;

(c) Plating can be performed easily on an electrode having a complex shape and depressed portions;

(d) The adhesion of the plated coat is superior; and (e) The plated coat has a high hardness and anticorrosiveness.

Preferred embodiments of the present invention are given below.

The cathode of this invention is produced by dipping a plate, perforated plate, lattice or mesh of iron, nickel-plated iron or nickel metal in an aqueous electroless plating bath of a specified composition to perform chemical plating on its surface. The chemical plating, or electroless plating, technique has long been known. The cathode metal is iron, preferably mild steel.

One ingredient contained in the plating bath is a water-soluble inorganic salt of nickel, cobalt or iron. These salts include sulfates, nitrates, carbonates, halides and cyanides. Specific examples of preferred salts are nickel sulfate, nickel chloride, cobalt sulfate, cobalt chloride, iron sulfate and iron chloride. The suitable concentration of the inorganic salt in the bath is at least 0.02 mole per liter. If the concentration is too high, precipitation occurs in the bath to render the bath turbid and also cause the loss of the salt. The optimal concentration is 0.02 to 0.3 mole/liter.

A second ingredient contained in the plating bath is an alkali metal salt of hypophosphorous acid. It has a reducing power, and causes the coprecipitation of phosphorus together with nickel, cobalt or iron on the surface of the electrode being treated at the time of chemical plating. This improves the adhesion and durability of the plated coat. If the concentration of the salt in the bath is too high, nickel, cobalt or iron is precipitated because of its reducing power to render the bath turbid. The optimal concentration is 0.01 to 0.2 mole/liter.

A third component of the plating bath is a water-soluble reducing agent which is a sulfur or selenium containing compound. Suitable compounds include alkali metal salts or ammonium salts of thiosulfuric acid, thiocyanic acid, sulfurous acid, dithionous acid and selenious acid, thiourea and hydrazinium sulfate. These compounds all have a moderate reducing power, and cause the coprecipitation of S or Se, on the surface of the electrode being treated, from the bath together with Ni, Co or Fe. If the concentration of the reducing agent is too high in the bath, precipitation of metal occurs in the bath to make the bath turbid. The optimal concentration of the reducing agent is 0.01 to 0.2 mole/liter.

The improved cathode in accordance with this invention is realized by the cooperative use of the three ingredients contained in the plating bath. Cathodes treated with a plating bath containing only the first ingredient (nickel, salt, etc.) and the second ingredient (alkali metal salt of hypophosphorous acid) show a higher hydrogen overvoltage than a non-treated cathode. Cathodes treated with a bath containing the first ingredient and the third ingredient (sulfur or selenium compound) alone show a low hydrogen overvoltage in the early stage, but have poor durability, and during the electrolysis of the alkali metal salt aqueous solution for long periods of time, the level of the electrolytic voltage approaches that of the non-treated cathode. In contrast, it is surprising to note that the cathode of this invention chemically plated by a plating bath containing the above-mentioned three ingredients is maintained at a considerably low level of electrolytic voltage during electrolysis for long periods of time.

The preferred conditions for plating in an aqueous electroless plating bath containing the three ingredients are described below.

The bath should be acidic. Its pH is preferably 4–6, more preferably 4–5. An inorganic or organic acid may be used in order to adjust the acidity of the bath to the desired pH. The organic acid, especially carboxylic acid, is preferred. Suitable organic carboxylic acids include, for example, formic acid, acetic acid, propionic acid, butyric acid, valeric acid, lactic acid, glycolic acid, tartaric acid, citric acid, succinic acid, malonic acid, glutamic acid and adipic acid. Desirably, a buffer is added to the bath in order to prevent fluctuation of its pH during the chemical plating operation. As the buffer an alkali metal salt of organic acid is preferably used. The amount of the buffer is generally about 0.02 to 0.2 mole/liter.

The temperature of the bath is maintained at about 50° to 100° C. Within a low temperature range of 50° to 60° C., the speed of plating is fairly low, and at a temperature of above 80° C., the speed of plating increases rapidly. Temperatures of more than 100° C., however, are difficult to apply commercially. The suitable temperature of the bath is therefore about 80° to 100° C.

The electroless plating is performed by simply dipping the cathodic metal substrate to be treated in the plating bath. The suitable dipping time varies according to the temperature of the bath. If the temperature of the bath is within a high temperature region of 80° to 100° C., the desired plated cathode can be obtained by dipping the substrate in the bath for about 20 to 60 minutes. The thickness of the plated layer is preferably at least about 10 microns. If the thickness of the layer is increased too much, the performance of the resulting cathode does not change so much, and no particular benefit can be obtained. The plated layer has a considerably rough structure which becomes somewhat rougher in the course of the electrolysis of an aqueous solution of alkali metal salt or of water.

The cathode of the invention obtained by electroless plating, which has been described hereinabove, permits a markedly lower level of electrolytic voltage in the long-term electrolysis of an aqueous solution of an alkali metal salt than the non-treated cathode and the cathodes electroplated as in the U.S. patent cited above.

The following examples illustrate the present invention and its superior advantages. Examples 1 to 3 are typical examples of the invention, and Examples 4 to 7 are comparative examples.

A BRIEF DESCRIPTION OF THE DRAWING

Figure 2:
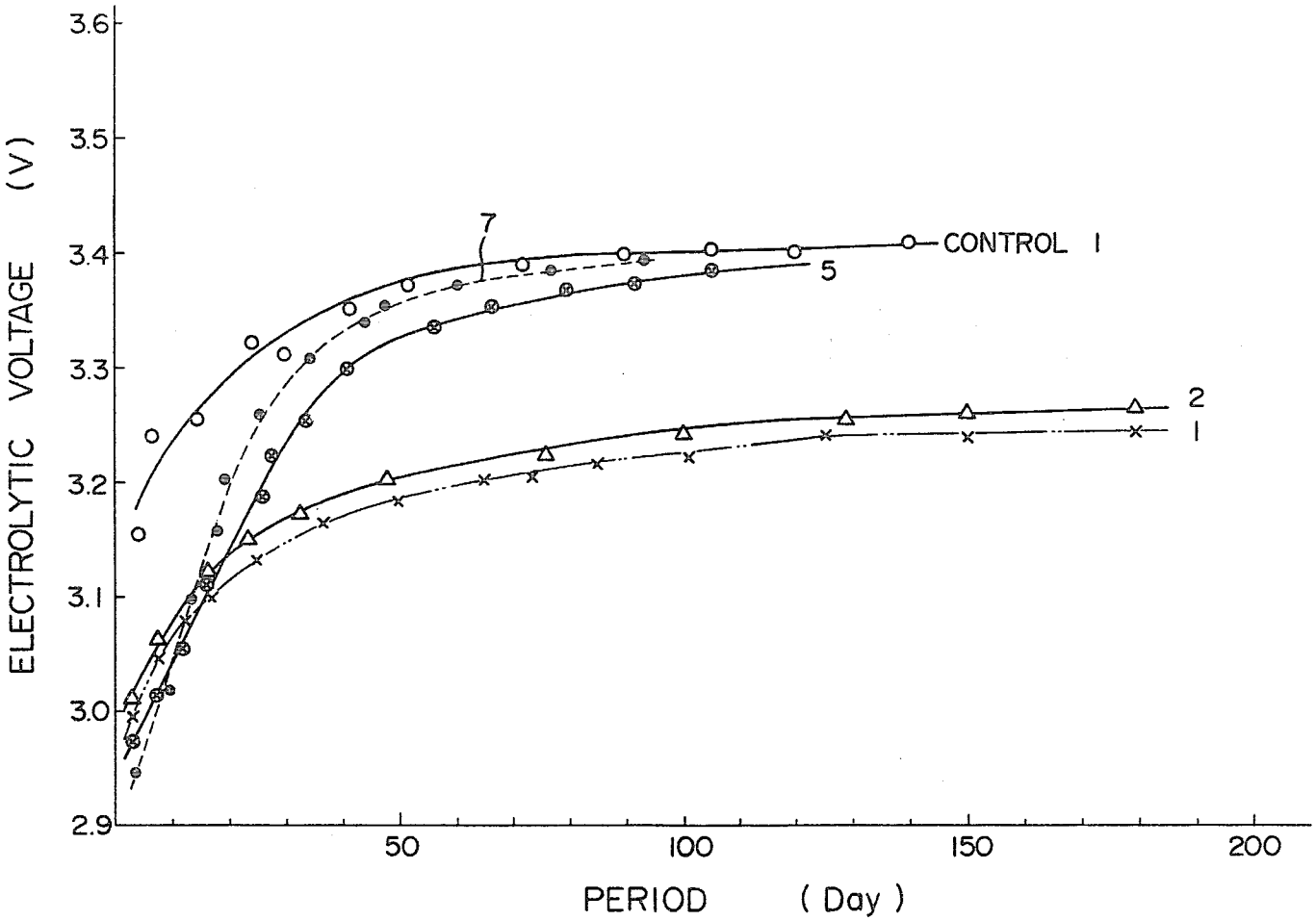

FIG. 1 is a graphic representation showing the hydrogen overvoltage of the cathodes obtained in these examples; and FIG. 2 is a graphic representation obtained by plotting changes with time of the electrolytic voltages when a saturated aqueous solution of sodium chloride was continuously electrolyzed for a long period of time using the cathodes produced in the examples.

EXAMPLE 1 (INVENTION)

A mild steel wire gauze (the diameter of wire 2.4 mm; mesh 4 mm) was dipped in an aqueous plating bath of the following formulation to plate the surface of the wire gauze. The temperature of the bath was 90° C., and the dipping time was 1 hour.

Formulation of the plating bath

Nickel sulfate: 30 g/liter
Sodium thiosulfate: 20 g/liter
Sodium hypophosphite: 10 g/liter
Sodium acetate (buffer): 10 g/liter

EXAMPLE 2 (INVENTION)

A mild steel wire gauze was plated under the same conditions as in Example 1 except that sodium selenite was used instead of the sodium thiosulfate in the plating bath.

EXAMPLE 3 (INVENTION)

A mild steel wire gauze was plated under the same conditions as in Example 1 except that cobalt sulfate was used instead of the nickel sulfate in the plating bath.

EXAMPLE 4 (COMPARATIVE EXAMPLE)

A mild steel wire gauze was plated under the same conditions as in Example 1 except that a plating bath of the following formulation which contained a nickel salt and a hypophosphite but was free from a sulfur or selenium compound was used.

Formulation of the plating bath

Nickel sulfate: 30 g/liter
Sodium hypophosphite: 80 g/liter
Sodium acetate (buffer): 10 g/liter
Adjusted to pH 4 with acetic acid

EXAMPLE 5 (COMPARATIVE EXAMPLE)

A mild steel wire gauze was plated under the same conditions as in Example 4 except for using a plating bath of the following formulation, which contained a nickel salt and a sulfur compound, but was free from a hypophosphite.

Formulation of the plating bath

Nickel sulfate: 30 g/liter
Sodium thiosulfate: 20 g/liter
Sodium acetate: 10 g/liter
Adjusted to pH 4 with acetic acid

EXAMPLE 6 (COMPARATIVE EXAMPLE)

The same procedure as in Example 5 was repeated except that sodium selenite was used instead of sodium thiosulfate in the plating bath.

EXAMPLE 7 (COMPARATIVE EXAMPLE)

A mild steel wire gauze was treated by the electroplating method dislosed in U.S. Pat. No. 1,818,579. The composition of an aqueous electroplating bath and the conditions for electroplating were as follows:

Formulation of the bath

Nickel sulfate: 60 g/liter
Sodium thiosulfate: 120 g/liter
Adjusted to pH 4 with acetic acid Electroplating conditions Current density: 0.3 A/dm$^2$
Temperature: 40° C.
Time: 3 hours
Anode: iron plate Hydrogen overvoltage The hydrogen overvoltages of each of the cathodes obtained in the above examples were measured at a current density of 10, 20, and 30 A/dm$^2$. The results are plotted in FIG. 1, in which the reference numerals correspond to the Example numbers, Control 1 corresponds to a non-treated mild steel wire gauze and control 2 corresponds to a non-treated perforated nickel plate.

As is seen from FIG. 1, the mild steel cathodes (1, 2 and 3) chemically plated by the present invention have a considerably lower hydrogen overvoltage than the non-treated Controls (about 0.15 volt lower). Cathode (4) chemically plated with a bath which contained a hypophosphite but was free from an S or Se compound shows a considerably higher hydrogen overvoltage than the non-treated cathodes (Controls). Accordingly, it is especially noteworthy that the cathodes of this invention show such a low hydrogen overvoltage as described above.

Cathodes (5 and 6), chemically plated with a bath which contained an S or Se compound but was free from the hypophosphite, and the cathode (7), electroplated, showed a lower hydrogen overvoltage than the cathodes of the present invention. These, however, do not last as can be seen from the electrolyzing experiments of an aqueous solution of an alkali metal salt.

Test of electrolysis of an aqueous solution of an alkali metal salt

A saturated aqueous solution of sodium chloride was electrolyzed continuously for 150 to 180 days using the cathodes (1 and 2) of this invention and the cathodes (5 and 7) as comparisons, and a non-treated cathode (Control 1). The electrolytic voltages with time were recorded.

The electrolyzing conditions, which substantially correspond to actual conditions in a commercial operation, were as follows:
Current density: 17.3 A/dm$^2$
Temperature: about 70° C.

The electrolytic voltages recorded are plotted in FIG. 2.

As shown in FIG. 2, the low electrolytic voltages in the early stage of electrolysis using the comparative cathodes (5 and 7) rapidly increased with the passage of time, and approached almost the same level as in the non-treated cathode (Control 1) after a lapse of about 50 days. In contrast, according to the cathodes (1 and 2) of this invention, the increase of the electrolytic voltage is small, and its level was maintained almost horizontal even after a lapse of about 50 days. The voltage was about 0.15 volt lower than in the case of Control 1 and cathodes 5 and 7. Since the electrolytic voltage can be maintained at a low level for long periods of time, a very great saving of electric power is brought about in commercial operation. Needless to say, the cathode of this invention can be used as a cathode for the electrolysis of water.

Thus, the superior effects of the improved cathode of this invention and the great commercial advantages brought about by the cathode are evident.

What we claim is:

1. A cathode for the electrolysis of an aqueous solution of an alkali metal salt or water, said cathode consisting of a plate, lattice or mesh of iron, nickel-plated iron or nickel, of which the surface is plated in an aqueous electroless plating bath consisting of an aqueous solution of an inorganic salt of nickel, cobalt or iron, an alkali metal salt of hypophosphorous acid and as a reducing agent, 0.01 to 0.02 mole, per liter of the plating bath, of a water-soluble sulfur or selenium containing compound.

2. The cathode of claim 1 in which the inorganic salt of nickel, cobalt or iron is selected from the sulfates, nitrates, carbonates, halides and cyanides of these metals.

3. The cathode of claim 1 in which the water-soluble sulfur or selenium containing compound is selected from the group consisting of alkali metal salts and ammonium salts of thiosulfuric acid, thiocyanic acid, sulfurous acid, dithionous acid and selenious acid, thiourea, and hydrazinium sulfate.

4. The cathode of claim 1 in which the aqueous electroless plating bath contains, per liter thereof, 0.02 to 0.3 mole of the inorganic salt of nickel, cobalt or iron, 0.01 to 0.2 mole of alkali metal hypophosphite, and 0.01 to 0.2 mole of the water-soluble reducing agent.

5. The cathode of claim 1 in which the aqueous electroless plating bath has a pH of 4 to 6.

6. The cathode of claim 1 in which the aqueous electroless plating bath is maintained at a temperature of about 50° to 100° C.

7. The cathode of claim 1 in which the plate is a perforated plate.

* * * * *